US005354147A

United States Patent [19]

Swisher, Jr.

[11] Patent Number: 5,354,147

[45] Date of Patent: Oct. 11, 1994

[54] PULVERIZING MACHINE HAVING A CUTTER ASSEMBLY TOWED IN BOTH FORWARD AND REVERSE DIRECTIONS

[76] Inventor: George W. Swisher, Jr., 1500 Dorchester Dr., Oklahoma City, Okla. 73120

[21] Appl. No.: 88,937

[22] Filed: Jul. 8, 1993

[51] Int. Cl.[5] ..... E01C 23/12

[52] U.S. Cl. ..... 404/90; 404/112; 299/39; 173/24; 172/435; 172/703

[58] Field of Search ..... 404/84.1, 89, 90, 91, 404/112; 299/40, 39, 81

[56] References Cited

U.S. PATENT DOCUMENTS

| | | | |
|---|---|---|---|
| 3,765,724 | 10/1973 | Hatcher et al. | 299/39 |
| 3,779,606 | 12/1973 | Hatcher et al. | 299/39 |
| 3,779,608 | 12/1973 | Hatcher et al. | 299/39 |
| 3,868,146 | 2/1975 | Ellis | 299/39 |
| 3,888,542 | 6/1975 | Gowler | 299/1 |
| 3,895,843 | 7/1975 | Wall et al. | 299/39 |
| 4,139,318 | 2/1979 | Jakob et al. | 404/90 |
| 4,140,420 | 2/1979 | Swisher, Jr. et al. | 404/84 |
| 4,221,434 | 9/1980 | Swisher, Jr. et al. | 299/39 |
| 4,335,921 | 6/1982 | Swisher, Jr. et al. | 299/86 |
| 4,637,753 | 1/1987 | Swisher, Jr. | 404/90 |
| 4,986,604 | 1/1991 | Meister | 299/39 |
| 5,190,398 | 3/1993 | Swisher, Jr. | 404/90 |

*Primary Examiner*—Ramon S. Britts
*Assistant Examiner*—Pamela Anne O'Connor
*Attorney, Agent, or Firm*—Dunlap, Codding & Lee

[57] ABSTRACT

A pulverizing machine with a cutter assembly adapted to be towed when the machine is moving either forward or in reverse. The machine includes a frame, a plurality of wheels supporting the frame, a cutter assembly carried by the frame and a pair of elevation cylinders for raising and lowering the cutter assembly. The cutter assembly has a cutter housing and a cutter drum rotatably mounted within the cutter housing. The cutter housing is pivotally suspended from the frame by a pair of chain cases, one on each side. Each chain case contains a chain drive assembly connected to the cutter drum to drive the rotation of the cutter drum. Cutter teeth extend from the cutter drum to pulverize material as the cutter drum is lowered and rotated into the material. A pair of rear cylinders are mounted between the rear of the cutter housing and the frame. When the machine is operated in the forward direction, the chain cases tow the cutter assembly. Conversely, when the machine is operated in the reverse direction, the rear cylinders are locked to tow the cutter assembly from the rear end of the frame.

13 Claims, 3 Drawing Sheets

PULVERIZING MACHINE HAVING A CUTTER ASSEMBLY TOWED IN BOTH FORWARD AND REVERSE DIRECTIONS

BACKGROUND OF THE INVENTION

1. Field of the Invention

The present invention relates generally to machines for pulverizing a surface in applications such as, but not limited to, reclaiming asphaltic material from a surface, stabilizing a soil base and removing overburden in open-pit mining.

2. Description of Related Art

U.S. Pat. No. 5,190,398 discloses a bidirectional apparatus for preparing a road bed. The cutter drum and cutter housing are carried from a generally vertical direction rather than being dragged from a horizontal direction.

With this construction, the leading end of the cutter housing may bind into the road bed and hamper the operation of the apparatus. In order to alleviate this problem, it is desirable to drag or pull the cutter housing over the surface when moving forward or in reverse. By towing the cutter housing from its leading end, the cutter housing is less likely to bind into the material.

SUMMARY OF THE INVENTION

The present invention comprises a frame, a plurality of rotatable wheels supporting the frame and a cutter assembly carried by the frame for pulverizing a surface. The cutter assembly includes a cutter housing with a cutter drum rotatably mounted within the cutter housing.

The cutter assembly is suspended from the frame by a pair of chain cases pivotally mounted to opposite sides of the frame. An elevation cylinder is provided on each side of the frame to raise and lower the cutter assembly. Each chain case contains a chain assembly for driving the rotation of the cutter drum. The cutter drum has a plurality of teeth which pulverize the surface when the cutter drum is positioned against the surface and rotated. A pair of rear cutter housing cylinders extend between the cutter housing and the frame.

The machine is adapted for operation in forward and reverse directions. When the frame is moving in the forward direction, the cutter housing is towed by the chain cases while the rear cutter housing cylinders are relaxed in order to float the rear end of the cutter housing. When the frame is moving in the reverse direction, however, the rear cutter housing cylinders are locked in position to tow the cutter housing with the rear cutter housing cylinders.

One object of the present invention is to provide a pulverizing machine which may be operated in both forward and reverse directions.

Another object of the present invention is to provide a pulverizing machine having a cutter housing which may be towed when the machine is moving in either the forward direction or the reverse direction.

Yet another object of the present invention is to provide a pulverizing machine having a cutting assembly capable of controlling the amount of material entering and exiting the cutter housing, whether the machine is moving forward or in reverse.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
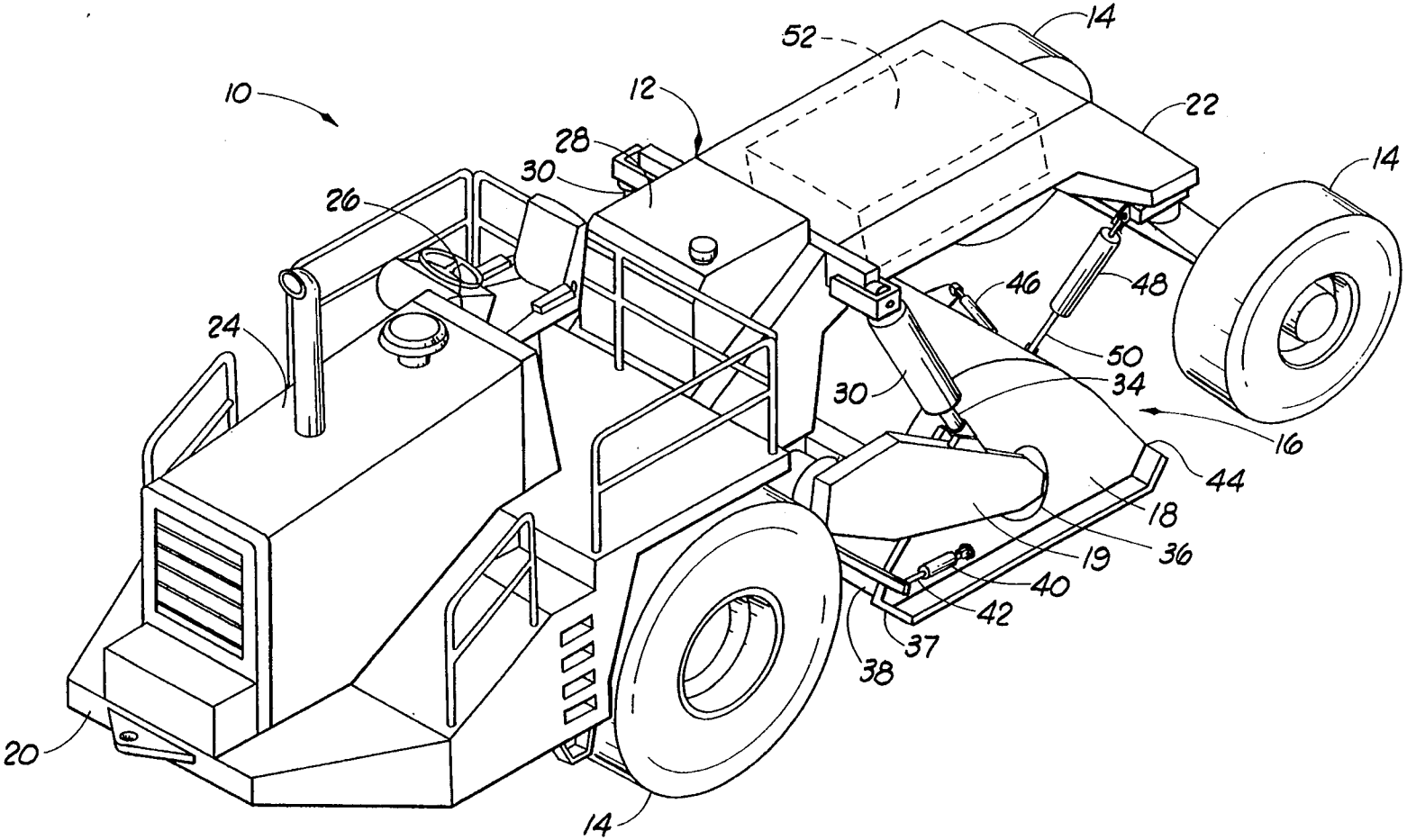
FIG. 1 is a perspective view of a pulverizing machine constructed in accordance with the present invention.

Referring to the drawings in general, and to FIG. 1 in particular, shown therein and designated by the general reference numeral 10 is a pulverizing machine, which includes a frame 12 supported for movement over a surface by a plurality of rotatable wheels 14. A cutter assembly 16 is carried by the frame 12 and comprises a cutter housing 18, a pair of chain cases 19 containing chain drive assemblies for rotating a cutter drum within the cutter housing 18. The cutter assembly 16 is carried between the front end 20 and the rear end 22 of the frame 12.

The machine 10 includes a conventional engine 24, drive train and transmission, operator's console 26, fuel tank 28, hydraulic system, electrical system and steering system. The steering system may be adapted for selection of leading two-wheel steering, trailing two-wheel steering, four-wheel coordinated steering or four-wheel crab steering. In addition, the machine 10 may be equipped with two-wheel or four-wheel drive.

Various mechanisms and controls which are suitable components of the machine 10 are disclosed in U.S. Pat. No. 5,190,398, entitled "APPARATUS FOR PREPARING A ROAD BED," which is hereby incorporated by reference. The construction of machine 10 for rotating the cutter drum and for carrying the cutter assembly 16, however, differs from that of the apparatus described in U.S. Pat. No. 5,190,398.

The cutter assembly 16 is supported by a pair of elevation cylinders 30 which are clevis-mounted to opposite ends of a cross-beam 32 of the frame 12. The pistons 34 of the elevation cylinders 30 are connected to the chain case 19 on the corresponding side of the cutter assembly 16.

The driving shaft of each chain drive assembly extends through a travel slot 36 in the corresponding side of the cutter housing 18. The travel slot 36 is curved such that each chain case 19 and the cutter drum swing an arc as the elevation cylinders 30 raise or lower the cutter drum.

It should be appreciated that, when the chain cases 19 reach either end of the travel slots 36, the elevation cylinders 30 move the cutter housing 18 as well as the cutter drum. Accordingly, the cutter drum has a range of movement, defined by the travel slots 36, independent from the cutter housing 18.

A front opening extends along the front end 37 of the cutter housing 18 and a front door 38 is pivotally mounted over the front opening. A pair of front door cylinders 40 are mounted on opposite sides of the cutter housing 18 and have pistons 42 connected to opposite sides of the front door 38.

Similarly, a rear opening extends across the rear end 44 of the cutter housing 18 and a rear door (not visible in FIGS. 1 and 2) is pivotally mounted over the rear opening. A rear door cylinder 46 is attached to the cutter housing 18 and has a piston connected to the rear door.

A pair of rear cutter housing cylinders 48 are clevis-mounted between the rear side of the cutter housing 18 and the frame 12. The pistons 50 of the rear cutter housing cylinders are connected to the cutter housing 18 at positions approximately one-third of the distance from each side of the cutter housing 18.

A reservoir 52 is located within a rear portion of the frame 12. The reservoir 52 is provided to contain liquid used to spray on material being pulverized and to provide weight for counter-balancing the load toward the front end 20 of the machine 10.

Figure 2:
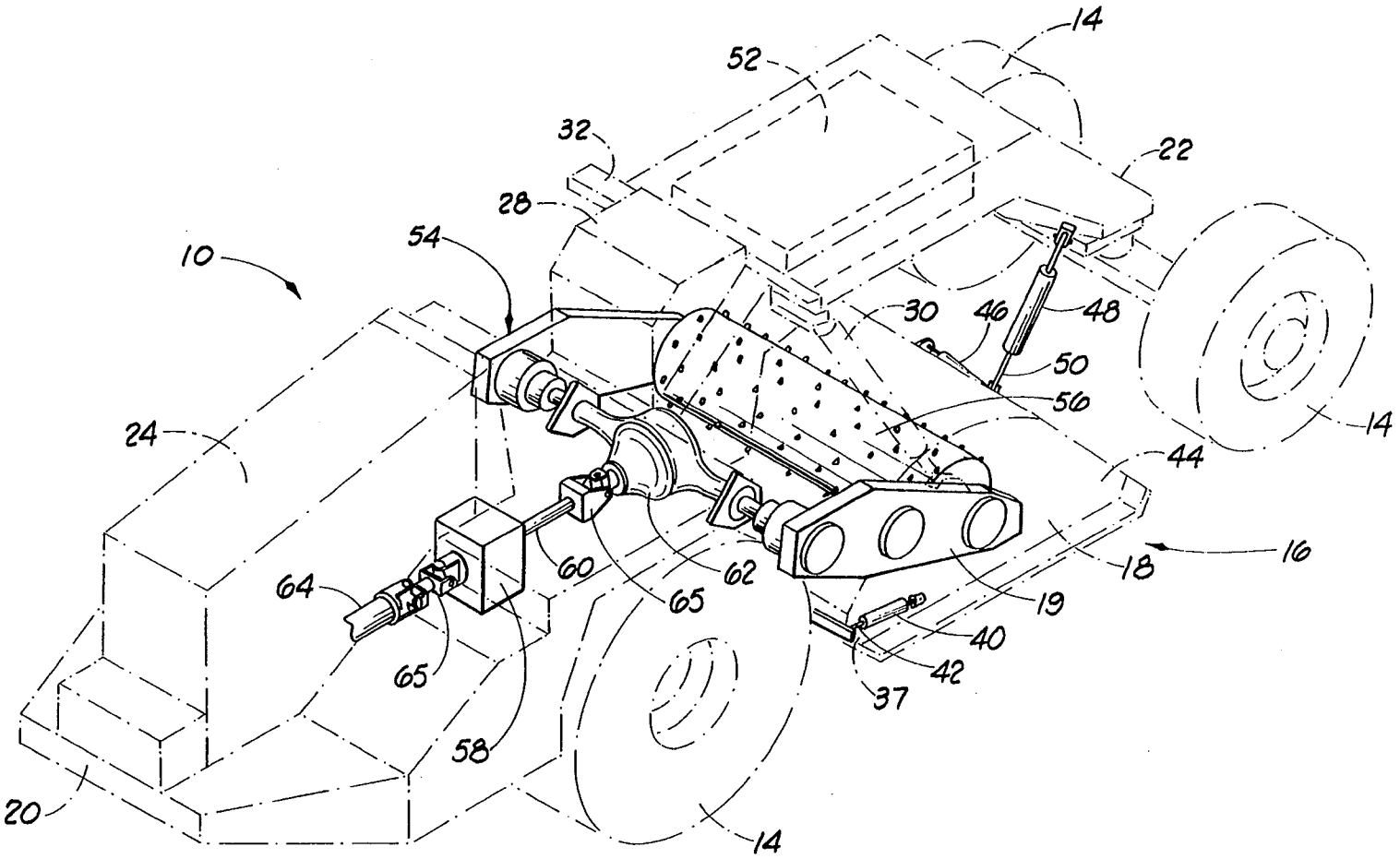
FIG. 2 is a perspective view of the pulverizing machine illustrating the cutter drive assembly.

With reference to FIG. 2, shown therein is a drive assembly 54 for the cutter drum 56. The drive assembly 54 includes a cutter transmission 58, a cutter drive shaft 60, a cutter differential 62 and the chain drive assemblies housed in the chain cases 19.

The cutter transmission 58 is connected to the power take-off drive shaft 64 of the engine, which rotates the drive shaft of the cutter transmission 58. The cutter transmission 58 rotates the cutter differential 62, which in turn rotates the chain drive assemblies. U-joint assemblies 65 are used to connect the power take-off drive shaft 64 to the cutter transmission 58 and the cutter transmission 58 to the cutter differential 62. Conventional shear pin and shock-absorbing components may also be inserted into the cutter drive assembly 54.

Operation

Figure 3:
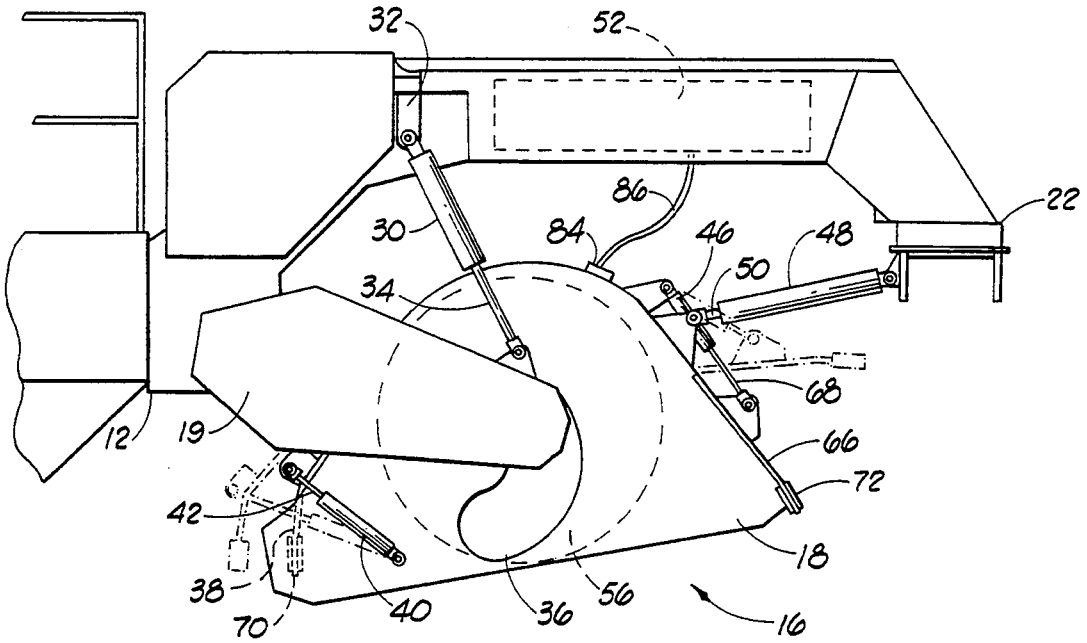
FIG. 3 is a side elevation of a portion of the machine of FIG. 1 with the cutter assembly elevated.

Referring now to FIG. 3, shown therein is the cutter assembly 16 in the fully elevated position. In this position, the machine 10 is prepared for travel with the entire cutter assembly 16 is raised from the surface.

The pistons 34 of the elevation cylinders 30 are retracted to pull both the cutter drum 56 and the cutter housing 18 upward away from the surface. The rear cutter housing cylinders 48 should be unlocked to allow their respective pistons 50 to retract as the pistons 34 of the elevation cylinders 30 are retracted.

Typically the front door 38 and the rear door 66 of the cutter housing 18 are locked closed when the machine 10 is not in operation. As shown in FIG. 3, the pistons 42 of the front door cylinders 40 are retracted to close the front door 38 and extended (shown in phantom lines) to open the front door 38.

In contrast, the piston 68 of the rear door cylinder 46 is retracted (shown in phantom lines) to open the rear door 66 and extended to close the rear door 66. The front door 38 and the rear door 66 have a plate 70 and 72, respectively, for striking off pulverized material leaving the cutter housing 18.

Figure 4:
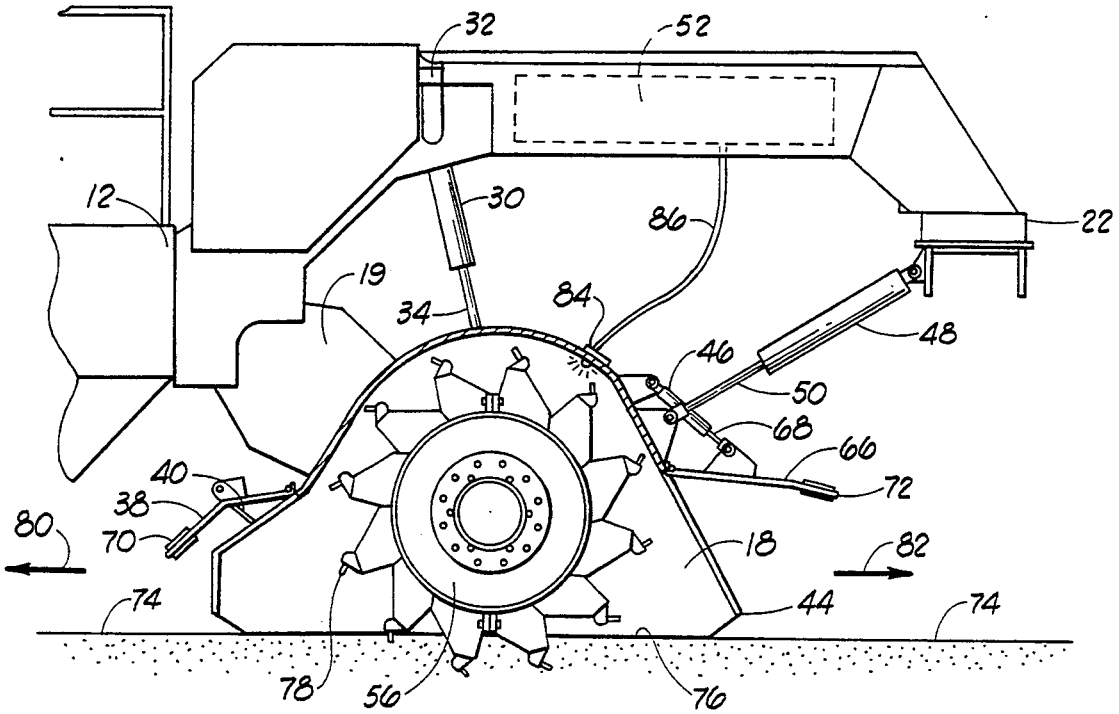
FIG. 4 is a partly sectional side view of the machine of FIG. 1 with the cutter assembly in operation.

Turning to FIG. 4, shown therein is the cutter assembly 16 in operation. The pistons 34 of the elevation cylinders 30 are extended to rest the cutter housing 18 on the surface 74 and to extend the cutter drum 56 through the cutter opening 76 to the surface 74 to be pulverized.

The cutter drum 56 has a plurality of cutter teeth which cooperate to break up the material as the cutter drum 56 is rotated. One of the cutter teeth is designated by reference numeral 78 and is generally representative of the teeth of the cutter drum 56. The construction of suitable cutting teeth 78 and their mounting to the drum 56 are disclosed in U.S. Pat. Nos. 4,139,318 and 4,335,921, which are hereby incorporated by reference.

It should be appreciated that the cutter drum 56 may be lowered to pulverize material to a variety of depths while the cutter housing 18 is towed over the surface 74. The variety of depths for the cutter drum 56 is made possible by the sliding movement of the cutter drum chain drive through the travel slots 36 of the cutter housing 18.

When the machine is moving in the forward direction, indicated by direction arrow 80, the cutter housing 18 is towed by the chain cases 19, which have one end pivotally mounted to the frame 12 and the other end journaled through the corresponding travel slot 36 of the cutter housing 18. During forward movement of the machine 10, the front door 38 may be closed if the surface 74 is an even surface, such as asphalt pavement. If the surface is an uneven surface, it may be necessary to open the front door 38 at least partially to facilitate towing the cutter housing 18 over the surface 74.

In forward movement, the rear door 66 is generally opened enough to retain some material within the cutter housing 18 and to strike off a substantially even level of pulverized material leaving the cutter housing 18. The pistons 50 of the rear cutter housing cylinders 48 are relaxed and allowed to float while the machine 10 is being operated in the forward direction 80.

When the machine 10 is moving in the reverse direction, indicated by direction arrow 82, the rear end 44 of the cutter housing leads and the front end trails. Accordingly, the rear cutter housing cylinders 48 are locked in position so that the cutter housing 18 is towed from the rear end 22 of the frame 12. The rear door 66 may be closed when pulverizing a substantially even surface 74 or may be opened at least partially to facilitate towing the cutter housing 18 over an uneven surface 74. In the reverse direction 82, the front door 38 is opened enough to retain a volume of material in the cutter housing 18 and to strike off a level of pulverized material leaving the cutter housing 18.

As shown in FIGS. 3 and 4, one or more spray nozzles 84 may be mounted to the cutter housing 18 to spray liquid into the cutter housing 18 as material is being pulverized therein. A suitable hose 86 connects each spray nozzle 84 to a supply of liquid. Each spray nozzle 84 may be connected to the reservoir 52 mounted in the frame 12, as shown in FIGS. 3 and 4. The spray nozzles 84 may also be connected to an on-board tank or a tank truck as described in U.S. Pat. No. 5,190,398. Any conventional components of pumps, valves and controls may be used to supply liquid under pressure to the spray nozzles 84.

Changes may be made in the combinations, operations and arrangements of the various parts and elements described herein without departing from the spirit and scope of the invention as defined in the following claims.

What is claimed is:

1. A machine for pulverizing a surface, the machine comprising:

a frame having a front end and a rear end;

a plurality of wheels rotatably mounted to said frame for supporting and moving said frame in a forward or a reverse direction;

a cutter assembly carried by said frame, said cutter assembly including:

a cutter housing having a front end, a rear end and a cutter opening disposed toward a surface to be pulverized; and a cutter drum rotatably mounted within the cutter housing, the cutter drum having a plurality of teeth for pulverizing the surface while said frame is moving in either the forward or the reverse direction;

front tow means for towing the cutter housing while said frame is moving in the forward direction; and rear tow means for towing the cutter housing while said frame is moving in the reverse direction.

2. The machine of claim 1 further comprising: means for adjusting the elevation of said cutter assembly relative to the surface.

3. The machine of claim 1 further comprising: means for adding liquid to the surface being pulverized.

4. The machine of claim 3 further comprising: a reservoir mounted to said frame for carrying liquid.

5. The machine of claim 4 wherein said reservoir is positioned to counter-balance disproportionate weight upon said wheels.

6. The machine of claim 1 further comprising:

a front door extending across the front end of the cutter housing; and means for adjusting the position of said front door.

7. The machine of claim 1 further comprising:

a rear door extending across the rear end of the cutter housing; and means for adjusting the position of said rear door.

8. A machine for pulverizing a surface, the machine comprising:

a frame having a front end and a rear end;

a plurality of wheels rotatably mounted to said frame for supporting and moving said frame in a forward or a reverse direction;

a cutter assembly carried by said frame, said cutter assembly including:

a cutter housing having a cutter opening disposed toward a surface to be pulverized and a leading end and a trailing end when said frame is moving in either the forward or the reverse direction; and a cutter drum rotatably mounted within the cutter housing, the cutter drum having a plurality of teeth for pulverizing the surface while said frame is moving in either the forward or the reverse direction; and means for towing the cutter housing when said frame is moving in either the forward or the reverse direction.

9. The machine of claim 8 further comprising:

means for adjusting the elevation of said cutter assembly relative to the surface.

10. The machine of claim 8 further comprising:

means for adding liquid to the surface being pulverized.

11. The machine of claim 10 further comprising: a reservoir mounted to said frame for carrying liquid.

12. The machine of claim 11 wherein said reservoir is positioned to counter-balance disproportionate weight upon said wheels.

13. The machine of claim 8 further comprising:

a leading door extending across the leading end of the cutter housing;

a trailing door extending across the trailing end of the cutter housing; and means for adjusting the positions of the leading door and the trailing door.

* * * * *